US011241702B2

(12) United States Patent
Huffington et al.

(10) Patent No.: US 11,241,702 B2
(45) **Date of Patent: *Feb. 8, 2022**

(54) SHOWERHEAD WITH SCANNER NOZZLES

(71) Applicant: Delta Faucet Company, Indianapolis, IN (US)

(72) Inventors: Todd A. Huffington, Avon, IN (US); Gregory A. Russell, Catonsville, MD (US)

(73) Assignee: Delta Faucet Company, Indianapolis, IN (US)

( * ) Notice: Subject to any disclaimer, the term of this patent is extended or adjusted under 35 U.S.C. 154(b) by 112 days.

This patent is subject to a terminal disclaimer.

(21) Appl. No.: 16/394,806

(22) Filed: Apr. 25, 2019

(65) Prior Publication Data

US 2019/0247868 A1 Aug. 15, 2019

Related U.S. Application Data

(63) Continuation of application No. 15/918,569, filed on Mar. 12, 2018, now Pat. No. 10,399,094, which is a continuation of application No. 15/139,565, filed on Apr. 27, 2016, now Pat. No. 9,943,863.

(60) Provisional application No. 62/154,445, filed on Apr. 29, 2015.

(51) Int. Cl.

| | |
|---|---|
| ***B05B 1/18*** | (2006.01) |
| ***B05B 1/08*** | (2006.01) |
| *B05B 15/654* | (2018.01) |
| *B05B 7/08* | (2006.01) |

(52) U.S. Cl.

CPC ..... *B05B 1/185* (2013.01); *B05B 1/08* (2013.01); *B05B 7/0892* (2013.01); *B05B 15/654* (2018.02)

(58) Field of Classification Search

CPC .. B05B 1/08; B05B 1/18; B05B 1/185; B05B 7/0892; B05B 15/654

See application file for complete search history.

(56) References Cited

U.S. PATENT DOCUMENTS

| | | | |
|---|---|---|---|
| 3,185,166 | A | 5/1965 | Horton et al. |
| 3,437,099 | A | 4/1969 | Griffin, Jr. |
| 3,448,752 | A | 6/1969 | O'Neill |
| 3,459,847 | A | 8/1969 | Steptoe et al. |
| 3,563,462 | A | 2/1971 | Bauer |
| 3,586,024 | A | 6/1971 | Tuzson et al. |
| 3,741,481 | A | 6/1973 | Bauer |

(Continued)

FOREIGN PATENT DOCUMENTS

| | | |
|---|---|---|
| AU | 8899982 | 4/1983 |
| CN | 101366606 | 2/2009 |

(Continued)

OTHER PUBLICATIONS

Kohler Flipside™, "Turning showering on its head," 2010, printed from http://www.us.kohler.com/performanceshowers/handshowers, 1 page.

(Continued)

*Primary Examiner* — Darren W Gorman

(74) *Attorney, Agent, or Firm* — Bose McKinney & Evans LLP

(57) ABSTRACT

A showerhead assembly including a plurality of scanner nozzles. Each scanner nozzle includes an oscillation chamber fluidly coupled to an inlet aperture and an outlet aperture, and configured to discharge a random sweeping jet from the outlet aperture over a coverage area.

11 Claims, 7 Drawing Sheets

(56) References Cited

U.S. PATENT DOCUMENTS

| | | | |
|---|---|---|---|
| D228,908 | S | 10/1973 | Juhlin |
| 3,770,200 | A | 11/1973 | Bauer et al. |
| 4,052,002 | A | 10/1977 | Stouffer et al. |
| 4,122,845 | A | 10/1978 | Stouffer et al. |
| 4,151,955 | A | 5/1979 | Stouffer |
| 4,157,161 | A | 6/1979 | Bauer |
| 4,185,777 | A | 1/1980 | Bauer |
| 4,231,519 | A | 11/1980 | Bauer |
| 4,260,106 | A | 4/1981 | Bauer |
| 4,304,749 | A | 12/1981 | Bauer |
| 4,340,177 | A | 7/1982 | Huber |
| 4,398,664 | A | 8/1983 | Stouffer |
| 4,403,735 | A | 9/1983 | Weaver |
| 4,463,904 | A | 8/1984 | Bray, Jr. |
| 4,508,267 | A | 4/1985 | Stouffer |
| 4,562,867 | A | 1/1986 | Stouffer |
| 4,645,126 | A | 2/1987 | Bray, Jr. |
| 4,694,992 | A | 9/1987 | Stouffer |
| 4,721,251 | A | 1/1988 | Kondo et al. |
| RE33,158 | E | 2/1990 | Stouffer et al. |
| RE33,159 | E | 2/1990 | Bauer |
| 5,035,361 | A | 7/1991 | Stouffer |
| 5,060,867 | A | 10/1991 | Luxton et al. |
| 5,181,660 | A | 1/1993 | Stouffer et al. |
| 5,213,267 | A | 5/1993 | Heimann et al. |
| 5,213,269 | A | 5/1993 | Srinath et al. |
| 5,213,270 | A | 5/1993 | Stouffer et al. |
| 5,297,739 | A | 3/1994 | Allen |
| 5,749,525 | A | 5/1998 | Stouffer |
| 5,769,624 | A | 6/1998 | Luxton et al. |
| 5,820,034 | A | 10/1998 | Hess |
| 5,845,845 | A | 12/1998 | Merke et al. |
| 5,906,317 | A | 5/1999 | Srinath |
| 5,928,594 | A | 7/1999 | Foster |
| 5,971,301 | A | 10/1999 | Stouffer et al. |
| 6,062,491 | A | 5/2000 | Hahn et al. |
| 6,186,409 | B1 | 2/2001 | Srinath et al. |
| 6,240,945 | B1 | 6/2001 | Srinath et al. |
| 6,253,782 | B1 | 7/2001 | Raghu |
| 6,328,228 | B1 | 12/2001 | Bossini |
| 6,360,965 | B1 | 3/2002 | Clearman et al. |
| 6,408,866 | B1 | 6/2002 | Carver et al. |
| 6,457,658 | B2 | 10/2002 | Srinath et al. |
| 6,463,658 | B1 | 10/2002 | Larsson |
| 6,497,375 | B1 | 12/2002 | Srinath et al. |
| 6,502,796 | B1 | 1/2003 | Wales |
| RE38,013 | E | 3/2003 | Stouffer |
| 6,575,386 | B1 | 6/2003 | Thurber, Jr. et al. |
| 6,581,856 | B1 | 6/2003 | Srinath |
| D495,028 | S | 8/2004 | Jorgensen et al. |
| 6,805,164 | B2 | 10/2004 | Stouffer |
| 6,904,626 | B1 | 6/2005 | Hester et al. |
| 6,938,835 | B1 | 9/2005 | Stouffer |
| 6,948,244 | B1 | 9/2005 | Crockett |
| 7,111,800 | B2 | 9/2006 | Berning et al. |
| D529,986 | S | 10/2006 | Chan |
| D555,229 | S | 11/2007 | Wrobleski et al. |
| D557,766 | S | 12/2007 | Hoernig et al. |
| 7,316,362 | B2 | 1/2008 | Miyauchi |
| 7,360,723 | B2 | 4/2008 | Lev |
| D575,845 | S | 8/2008 | Lobermeier et al. |
| D578,181 | S | 10/2008 | Pan |
| 7,578,453 | B1 | 8/2009 | Wilson |
| D599,883 | S | 9/2009 | Tippens |
| D604,392 | S | 11/2009 | Schoenherr et al. |
| 7,665,676 | B2 | 2/2010 | Lev |
| 7,694,897 | B2 | 4/2010 | Bulan et al. |
| 7,766,291 | B2 | 8/2010 | Eilmus et al. |
| 7,770,820 | B2 | 8/2010 | Clearman et al. |
| 7,770,825 | B2 | 8/2010 | Kajuch |
| 7,775,456 | B2 | 8/2010 | Gopalan et al. |
| D626,194 | S | 10/2010 | Kakihana et al. |
| D633,174 | S | 2/2011 | Lee |
| D652,108 | S | 1/2012 | Eads et al. |
| D652,109 | S | 1/2012 | Nichols |
| D652,110 | S | 1/2012 | Nichols |
| D652,894 | S | 1/2012 | Nichols |
| 8,205,812 | B2 | 6/2012 | Hester et al. |
| 8,662,421 | B2 | 3/2014 | Russell et al. |
| 9,943,863 | B2 | 4/2018 | Huffington et al. |
| 10,399,094 | B2 | 9/2019 | Huffington et al. |
| 2003/0234303 | A1 | 12/2003 | Berning et al. |
| 2004/0164189 | A1 | 8/2004 | Berning et al. |
| 2004/0227021 | A1 | 11/2004 | Romack et al. |
| 2005/0001072 | A1 | 1/2005 | Bolus et al. |
| 2005/0098661 | A1 | 5/2005 | Lev |
| 2006/0108442 | A1 | 5/2006 | Russell et al. |
| 2006/0219822 | A1 | 10/2006 | Miller et al. |
| 2007/0158460 | A1 | 7/2007 | Lev |
| 2007/0246577 | A1 | 10/2007 | Leber |
| 2008/0073446 | A1 | 3/2008 | Zhou |
| 2008/0272203 | A1 | 11/2008 | Leber |
| 2009/0007330 | A1 | 1/2009 | Genord et al. |
| 2009/0206180 | A1 | 8/2009 | Wilson |
| 2010/0072307 | A1 | 3/2010 | Hester et al. |
| 2010/0237166 | A1 | 9/2010 | Nelson |
| 2011/0061692 | A1 | 3/2011 | Gopalan et al. |
| 2011/0233301 | A1 | 9/2011 | Gopalan et al. |
| 2013/0299608 | A1 | 11/2013 | Spangler |
| 2016/0082447 | A1 | 3/2016 | Gong |

FOREIGN PATENT DOCUMENTS

| | | |
|---|---|---|
| DE | 501821 | 6/1930 |
| DE | 1937798 | 2/1971 |
| DE | 2948559 | 6/1981 |
| EP | 0056508 | 7/1982 |
| WO | WO 99/26021 | 5/1999 |
| WO | WO 2006/025875 | 3/2006 |
| WO | WO 2006/039987 | 4/2006 |

OTHER PUBLICATIONS

Kohler, "Flipside™ 01 multifunction handshower K-17493," printed Dec. 21, 2011 from http://www.us.kohler.com/onlinecatalog, 2 pages.

Kohler Faucets, "Flipside™ 01 Four-Function Handshower K-17493, also K-45425," Dec. 21, 2011, 2 pages.

SHOWERHEAD WITH SCANNER NOZZLES

CROSS-REFERENCE TO RELATED APPLICATIONS

This application is a continuation application of U.S. patent application Ser. No. 15/918,569, filed Mar. 12, 2018, which is a continuation application of U.S. patent application Ser. No. 15/139,565, filed Apr. 27, 2016, which claims priority to U.S. Provisional Patent Application Ser. No. 62/154,445, filed Apr. 29, 2015, the disclosures of which are expressly incorporated by reference herein.

BACKGROUND AND SUMMARY OF THE INVENTION

The present invention relates generally to showerheads and, more particularly, to showerheads including three-dimensional (3D) scanner nozzles.

Showerhead assemblies are known to dispense water through outlets, such as nozzles, in order to generate a spray of water within a bathing area. Some such showerhead assemblies include mechanisms for adjusting the spray of water dispensed from the outlets. It is also known to provide a showerhead assembly including a handshower, which may direct a spray of water separate from a fixed showerhead. The handshower may be removably mounted or docked to the fixed showerhead wherein water may be delivered to the bathing area through both the showerhead and the handshower. Such showerhead assemblies are illustrated, for example, in U.S. Pat. No. 7,360,723 to Lev, U.S. Pat. No. 7,665,676 to Lev, U.S. Patent Application Publication No. 2009/0007330 to Genord et al. and U.S. Patent Application Publication No. 2013/0299608 to Spangler et al., the disclosures of which are expressly incorporated by reference herein.

According to an illustrative embodiment of the present disclosure, a showerhead assembly includes a fixed showerhead and a handshower removably coupled to the fixed showerhead. A first plurality of scanner nozzles are supported by the handshower, and a second plurality of scanner nozzles are supported by the fixed showerhead. Each of the scanner nozzles includes an oscillation chamber including an upstream end member and a downstream end member, an inlet aperture in the upstream end member and configured to be coupled to a pressurized water source for issuing a jet of water into the oscillation chamber, an outlet aperture in the downstream end member for discharging a jet of the pressurized water to atmosphere for spraying on an area, the oscillation chamber configured to support a toroid flow pattern, the toroid spinning about its cross-sectional axis and being supplied energy from the jet of water issued into the oscillation chamber, the toroidal flow pattern having diametrically opposed cross-sections which alternate in size to cause the jet to move in radial paths and also in tangential directions and thereby choose a different radial path at each sweep, whereby there is a random sweeping of the jet issuing from the outlet aperture over the area.

According to another illustrative embodiment of the present disclosure, a showerhead assembly includes a first fluid dispensing unit having a first plurality of scanner nozzles, and a second fluid dispensing unit having a second plurality of scanner nozzles. The first and second plurality of scanner nozzles each include an oscillation chamber configured to cause a pray jet to move in radial paths and in tangential directions and thereby choose a different radial path at each successive sweep, whereby there is a random sweeping of the jet issuing from the outlet aperture over a spray area.

According to a further illustrative embodiment of the present disclosure, a showerhead assembly includes a faceplate body having a front surface and defining a faceplate longitudinal axis extending perpendicular to the front surface. A housing includes a housing body coupled to the faceplate and having a rear wall supporting a fluid connector for receiving pressurized water from a water source. A plurality of stepped bores are formed within the body of the faceplate. A plurality of scanner nozzles are coupled to the faceplate, each of the scanner nozzles including an upstream end member and a downstream end member defining an oscillation chamber configured to cause a spray jet to move in radial paths and in tangential directions and thereby choose a different radial path at each successive sweep, whereby there is a random sweeping of the jet discharged from the scanner nozzle over a spray area.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1:
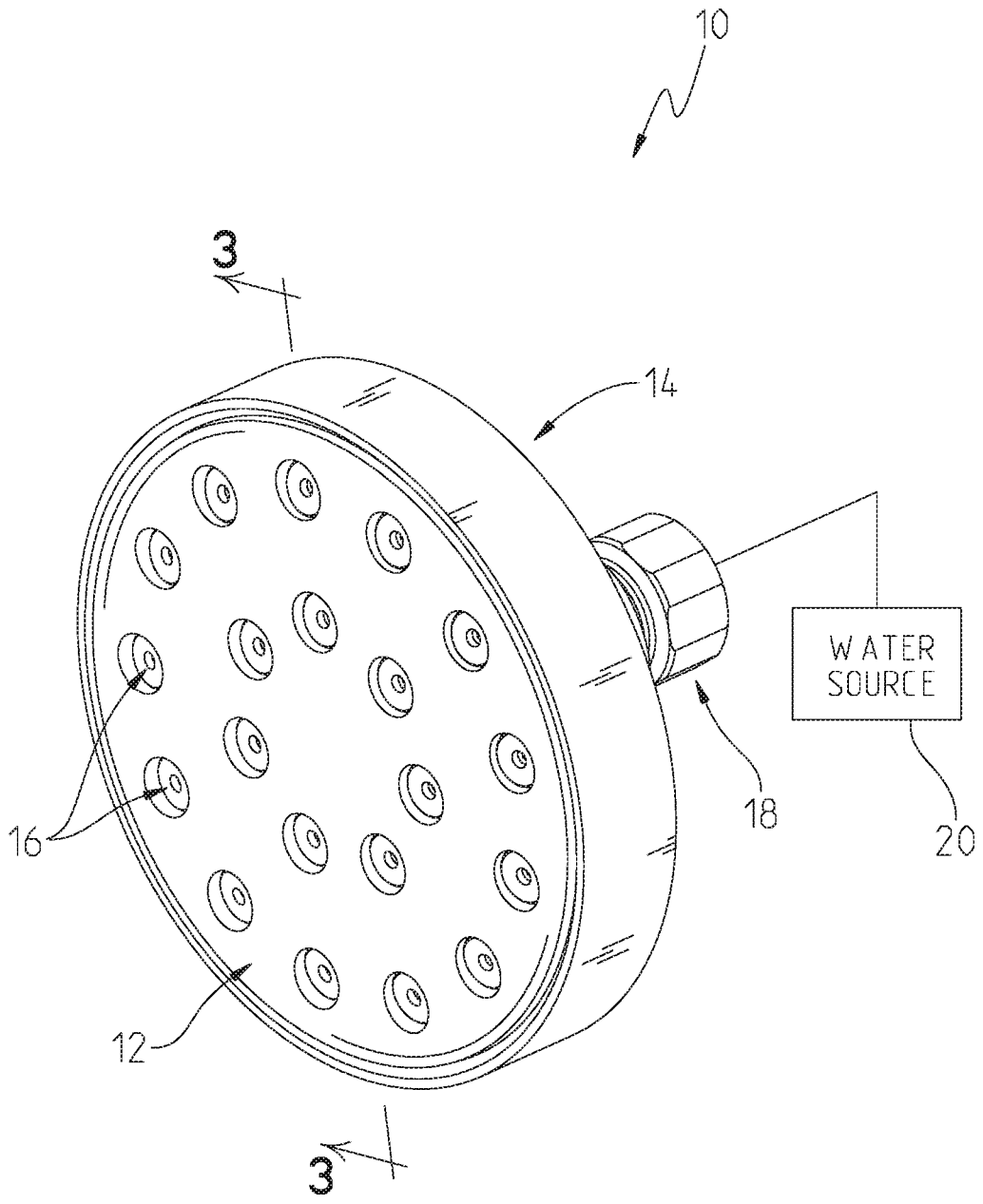
FIG. 1 is a perspective view of an illustrative showerhead assembly of the present disclosure.

Referring initially to FIG. 1, an illustrative showerhead assembly 10 includes a front faceplate 12 coupled to a rear housing 14. A plurality of scanner nozzles 16 are supported by the faceplate 12. A fluid connector 18 is supported by the rear housing 14 and is configured to be fluidly coupled to a pressurized water source 20, such as a shower pipe supported within a wall (not shown).

Figure 2:
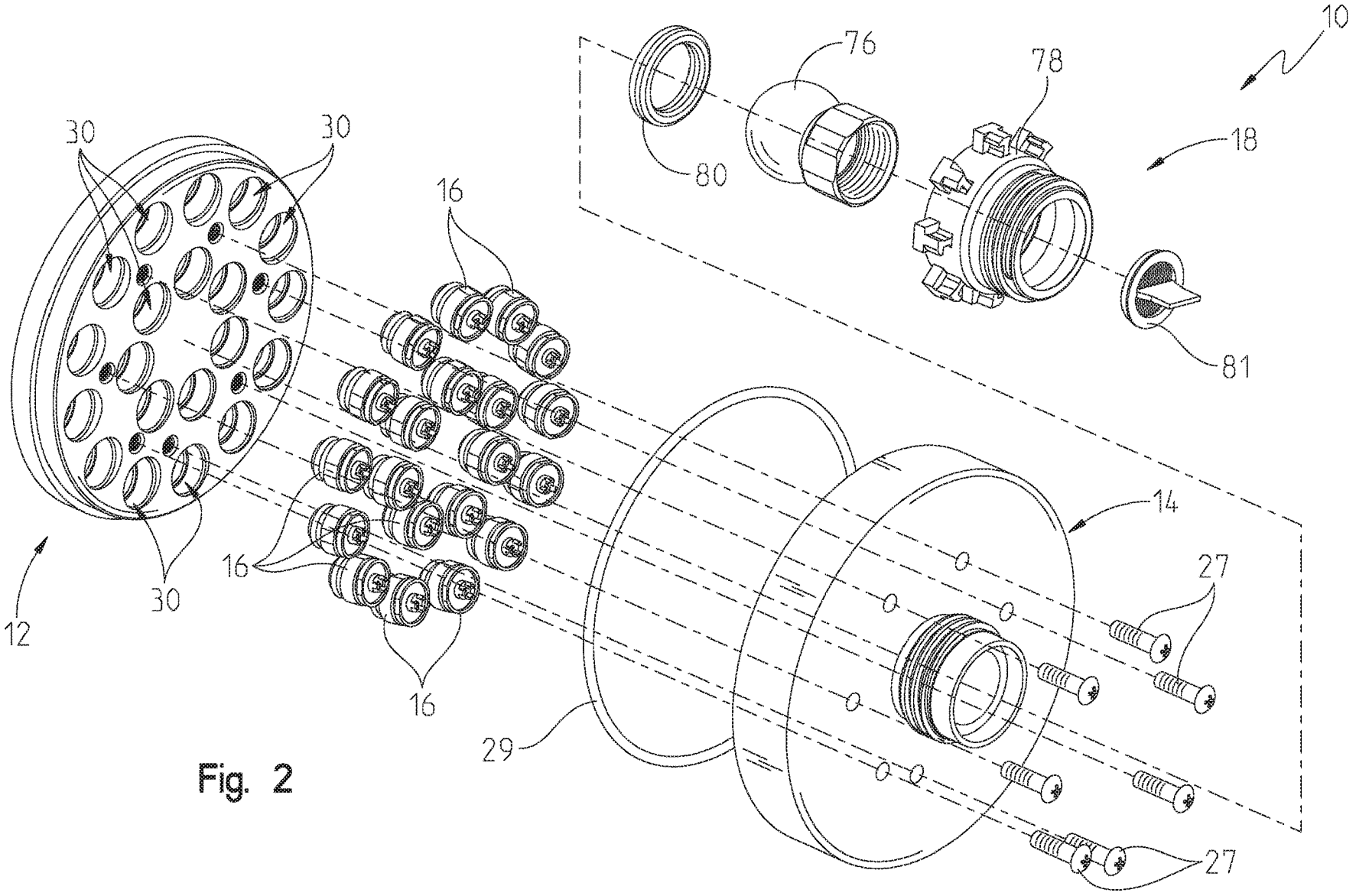
FIG. 2 is a rear partially exploded perspective view of the showerhead assembly of FIG. 1.
Figure 3:
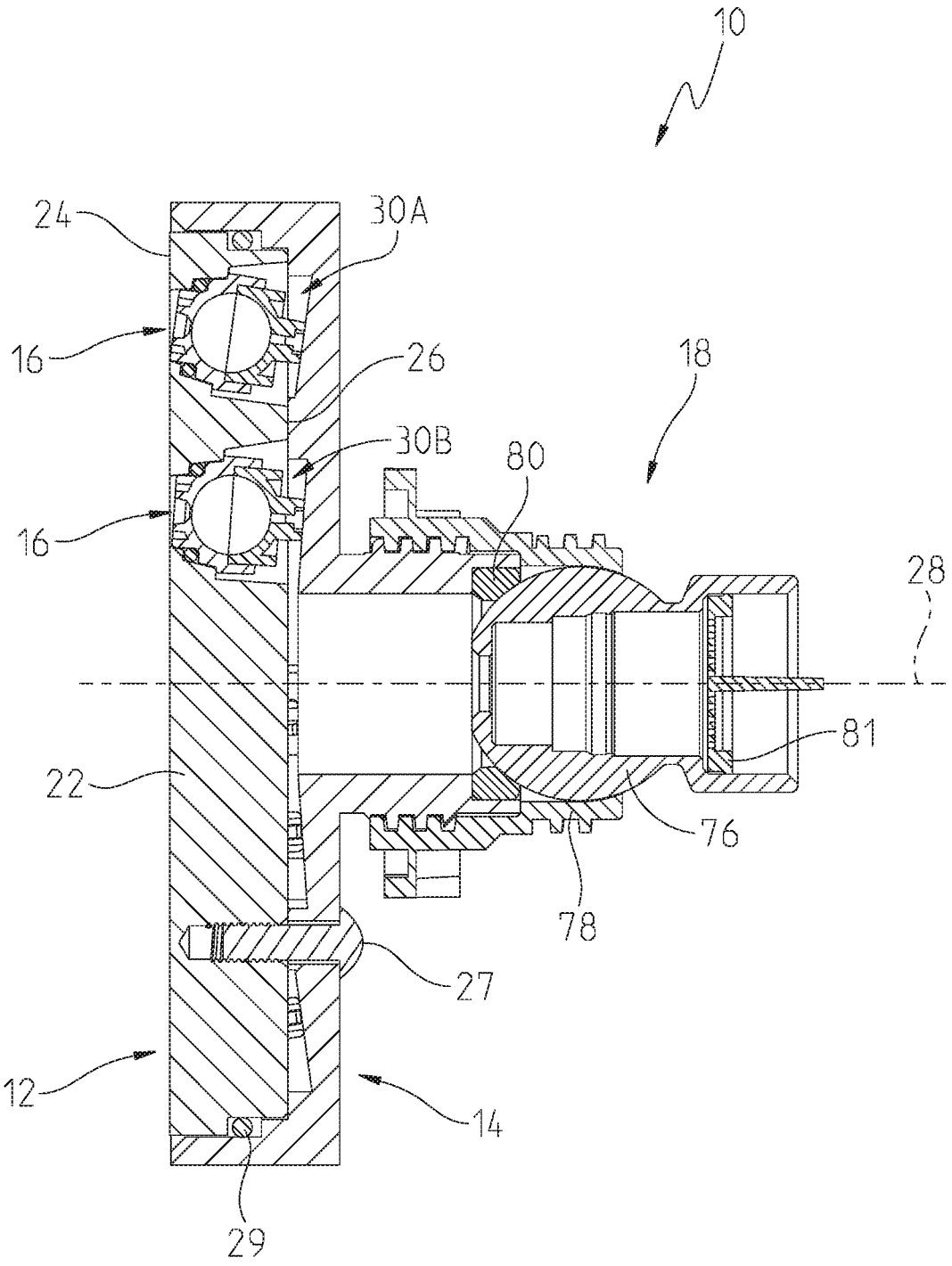
FIG. 3 is a cross-sectional view taken along line 3-3 of FIG. 1.

With reference to FIGS. 2 and 3, the front faceplate 12 illustratively includes a body 22 having a front surface 24 and a rear surface 26. The front faceplate 12 may be coupled to the rear housing 14 through conventional means, such as screws 27. Alternatively, ultrasonic welding, adhesives, etc. may be substituted for the screws 27. An o-ring 29 may be positioned intermediate the front faceplate 12 and the rear housing 14 to provide sealing therebetween.

A longitudinal faceplate axis 28 illustratively extends perpendicular to the front surface 24 of the front faceplate 12. A plurality of stepped bores 30 extend through the body 22 from the front surface 24 to the rear surface 26, each along a longitudinal bore axis 32. As shown in FIG. 3, the stepped bores 30 illustratively are arranged into an outer ring of stepped bores 30A and an inner ring of stepped bores 30B.

Figure 4:
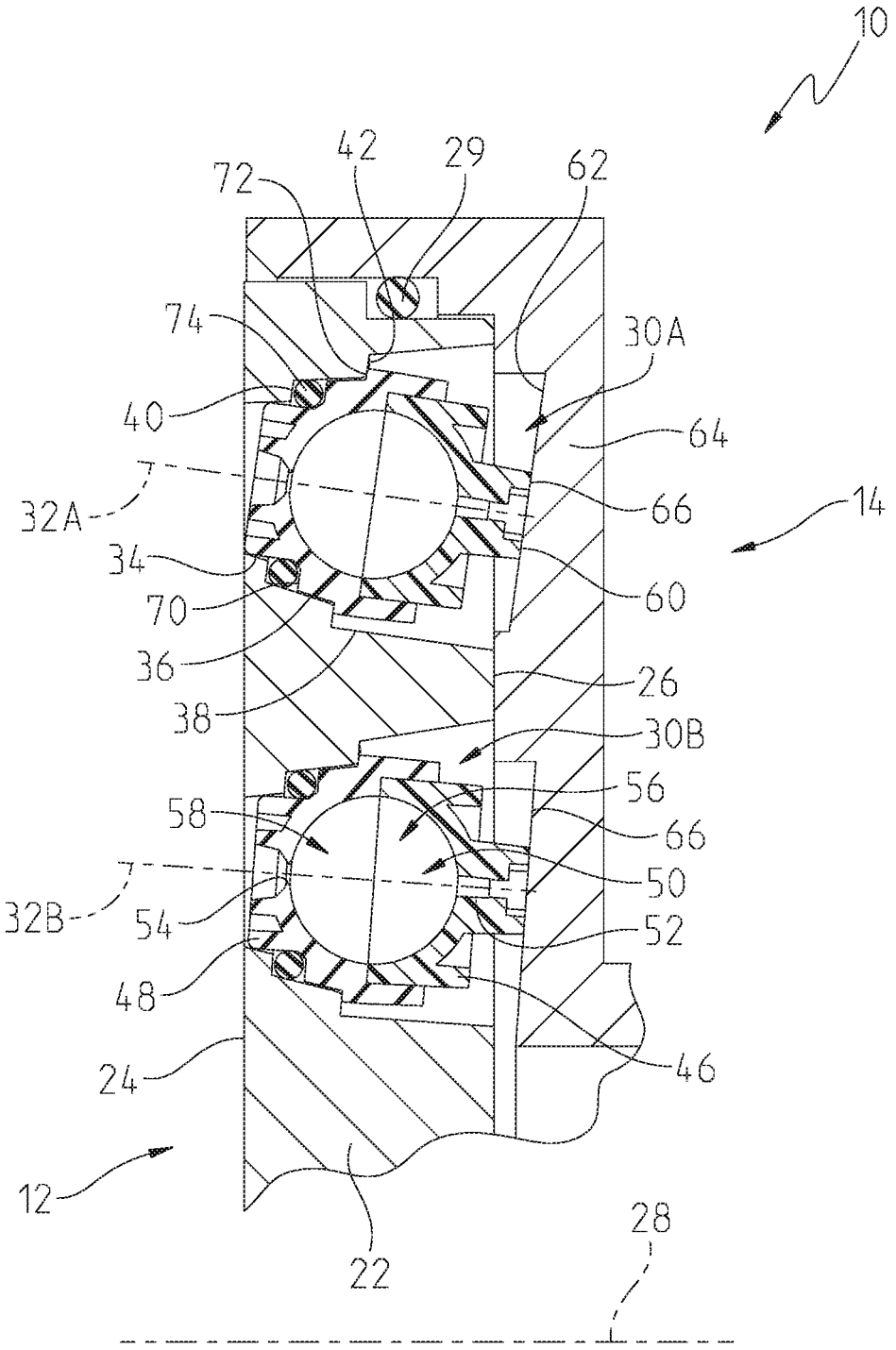
FIG. 4 is a detailed cross-sectional view of FIG. 3.

The longitudinal bore axis 32 is illustratively positioned at an angle to the longitudinal faceplate axis 28 (FIG. 4) to provide increased spray pattern coverage. In one illustrative embodiment, the longitudinal bore axis 32 is positioned at an angle as little as 0°, 2°, 4°, as great as 6°, 8° or 10° to the longitudinal faceplate axis 28. In one illustrative embodiment, the longitudinal bore axis 32A for an outer ring of stepped bores 30A (FIG. 3) is positioned at an angle to the longitudinal faceplate axis 28 different than the angle of longitudinal bore axis 32B for an inner ring of stepped bores 30B to the longitudinal faceplate axis 28. Illustratively, the longitudinal axis 32A for the outer ring of stepped bores 30A is positioned at a relatively larger angle, such as an angle of 8° to the longitudinal faceplate axis 28, and the longitudinal axis 32B for the inner ring of stepped bores 30B is positioned at a relatively smaller angle, such as an angle of 4°, to the longitudinal faceplate axis 28.

Each stepped bore 30 includes angled sidewalls 34, 36, 38. A plurality of steps or lips 40 and 42 extend between sidewalls 34, 36 and 36, 38 and face rearwardly toward the rear surface 26.

Illustratively, the body 22 of the faceplate 12 is molded from a polymer. The sidewalls 34, 36, 38 illustratively flare outwardly (are angled away from the bore axis 32 as the sidewalls 34, 36, 38 extend from the front surface 24 to the rear surface 26. This arrangement assists in manufacturing by permitting injection molding without requiring complex tool action. In other words, pins within the injection molds may be easily removed due to the tapered walls 34, 36, 38.

Each of the scanner nozzles 16 illustratively includes an upstream end member 46 and a downstream end member 48 defining an oscillation chamber 50. Additional details on an illustrative scanner nozzle are provided in U.S. Pat. No. 6,938,835 to Stouffer, the disclosure of which is expressly incorporated by reference herein.

The upstream end member 48 of each scanner nozzle 16 is illustratively formed of a polymer, and includes a screen or filter 60 configured to contact a front surface 62 of the rear wall 64 of the rear housing 14. Illustratively, the rear wall 64 of the housing includes a plurality of engagement portions 66 angled relative to the front surface 24 of the face plate 12. In other words, the engagement portions 66 are perpendicular to the bore axis 32. Each engagement portion 66 contacts the upstream end member 46 of a scanner nozzle 16.

The downstream end member 48 of each scanner nozzle 16 is illustratively formed of an elastomer or a polymer, and is illustratively coupled to upstream end member 46 through conventional means, such as ultrasonic welding or adhesives. Each downstream end member 48 illustratively includes a plurality of forwardly facing steps or lips 70, 72 configured to cooperate with the steps 40, 42 of the bore 30. An o-ring 74 is illustratively received intermediate the step 40 of the bore 30 and the step 70 of the scanner nozzle 16. As may be appreciated, when the faceplate 12 is coupled to the rear housing 14, the rear wall 64 contacts the rear end of the upstream end member 46 such that the o-ring 74 is compressed and the scanner nozzle 16 secured in place by the cooperating steps 40, 42, 70, 72.

The water source 20 is fluidly coupled to the showerhead assembly 10 through fluid connector 18. With reference to FIG. 3, the fluid connector 18 illustratively includes a shower ball 76, a screw ring 78 and a gasket 80. The shower ball 76 permits rotational movement of the showerhead 10 about orthogonal axes. A screen 81 or a flow restrictor may be provided to limit the flow rate of water from the water source 20 into the showerhead assembly 10.

Figure 5:
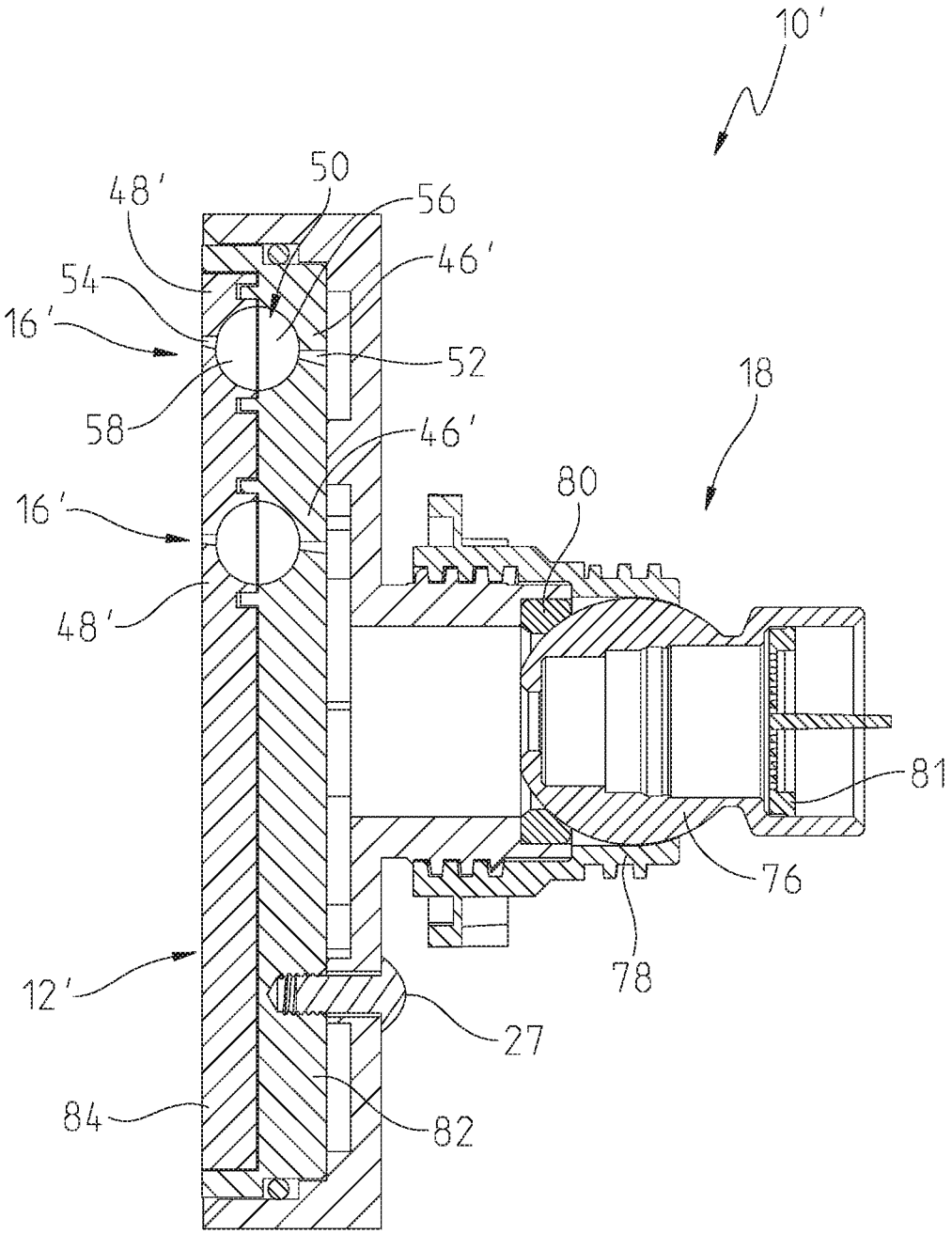
FIG. 5 is cross-sectional view of a further illustrative showerhead assembly.
Figure 6:
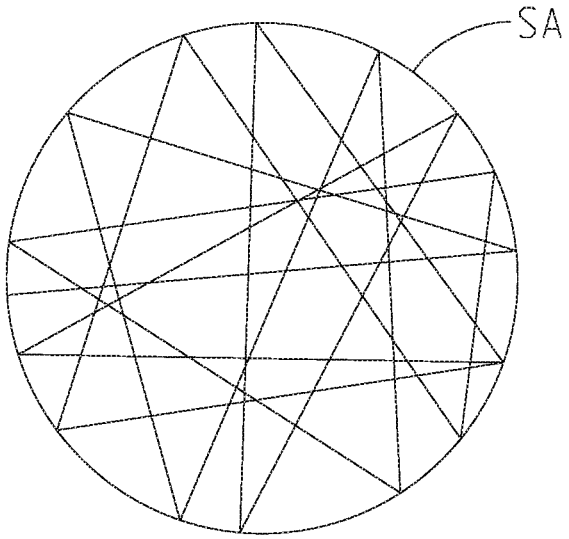
FIG. 6 is a diagrammatic illustration of the random sweeping of the spray jet produced by the scanner devices over a spray area.

In the further illustrative embodiment showerhead assembly 10 of FIG. 5, the plurality of scanner nozzles 16 may be integrally molded within the faceplate 12. More particularly, the upstream end member 46 may be molded into an upper or inner faceplate member 82 thereby defining the inlet aperture 52 and the first or upper hemisphere 56 of the oscillation chamber 50. Similarly, the downstream end member 48 may be molded into a lower or outer faceplate member 84 thereby defining the outlet aperture 54 and the second or lower hemisphere 58 of the oscillation chamber 50. The inner faceplate member 82 and the outer faceplate member 84 may be molded separately and then secured together using conventional means, such as ultrasonic welding or adhesives. Alternatively, the inner faceplate member 82 and the outer faceplate member 84 may be secured using screws, snaps, or hotplate welding. In the illustrative embodiment, the outlet aperture 54 is angled relative to the faceplate 12, and includes a conical shape larger at the end adjacent to the lower hemisphere 58. Illustratively, the angled outlet apertures 54 are molded as part of faceplate member 84.

Figure 7:
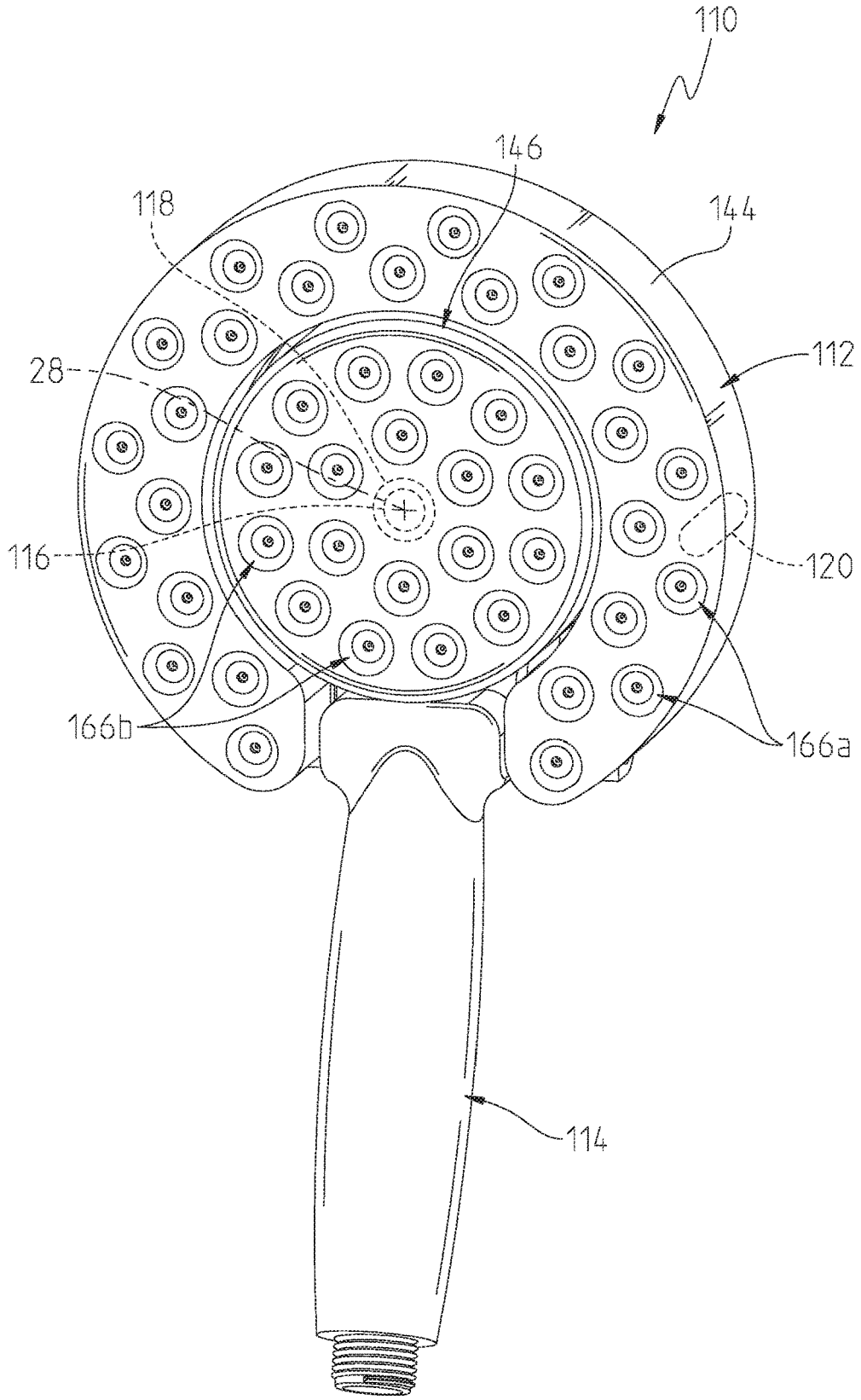
FIG. 7 is a perspective view of an illustrative showerhead assembly of the present disclosure, showing a handshower docked with a fixed showerhead.

Referring now to FIG. 7, a further illustrative showerhead assembly 110 illustratively includes a first fluid dispensing unit 112 and a second fluid dispensing unit 114 removably coupled to the first fluid dispensing unit 112. Illustratively, the first fluid dispensing unit 112 comprises a fixed showerhead, while the second fluid dispensing unit 114 comprises a handshower. The handshower 114 removably couples or docks with the fixed showerhead 112. Illustratively, a magnet 116 attracts a member 118 to hold the handshower 114 relative to the showerhead 112. Water source 20 provides water to the fixed showerhead 112 and the movable handshower 114.

In the illustrative embodiment of FIG. 2, the fixed showerhead 112 includes an arcuate housing 144 defining a center recess or opening 146 to receive the handshower 114. A flow restrictor (now shown) may be supported proximate a rear end of the fixed showerhead 112 and is configured to limit the rate of water flow therethrough to no more than a predetermined value. In one illustrative embodiment, the flow restrictor limits the water flow rate to no more than 2.5 gallons per minute (gpm). In another illustrative embodiment, the flow restrictor limits flow rate to no more than 2.0 gallons per minute (gpm) in accordance with the WaterSense Specification for Showerheads as released by the U.S. Environmental Protection Agency on Mar. 4, 2010 (available at the website http://www.epa.gov/watersense/docs/showerheads_finalspec508.pdf). A diverter valve 120 may also be supported by the fixed showerhead 112 and is configured to provide selective or combined water flow to either or both of the fixed showerhead 112 and the handshower 114.

A first plurality of scanner nozzles 166*a* are supported by the fixed showerhead 112. A second plurality of scanner nozzles 166*b* are supported by the handshower 114. The scanner nozzles 166*a* and 166*b*, and associated assembly within the fixed showerhead 112 and the handshower 114, may be substantially similar to that detailed above in connection with showerhead assembly 10.

Although the invention has been described in detail with reference to certain preferred embodiments, variations and modifications exist within the spirit and scope of the invention as described and defined in the following claims.

The invention claimed is:

1. A showerhead assembly comprising:

a front faceplate including a faceplate body having a front surface and defining a faceplate longitudinal axis extending perpendicular to the front surface;

a rear housing including a housing body coupled to the front faceplate and having a rear wall supporting a fluid connector for receiving pressurized water from a water source;

the front faceplate further including an outer ring of first bores within the faceplate body, each first bore including a longitudinal bore axis oriented at a first angle relative to the faceplate longitudinal axis;

the front faceplate further including an inner ring of second bores within the faceplate body, each second bore including a longitudinal bore axis oriented at a second angle relative to the faceplate longitudinal axis, the first angle being greater than the second angle;

a plurality of scanner nozzles supported within the outer ring of first bores and the inner ring of second bores and coupled to the front faceplate; and wherein each scanner nozzle includes an upstream end member and a downstream end member defining an oscillation chamber; and wherein the rear wall of the rear housing includes engagement portions angled relative to the faceplate longitudinal axis, each of the engagement portions contacting a respective one of the upstream end members.

2. The showerhead assembly of claim 1, wherein the outer ring of first bores and the inner ring of second bores comprise a plurality of stepped bores.

3. The showerhead assembly of claim 1, further comprising an o-ring compressed between each of the scanner nozzles and the front faceplate to secure the scanner nozzles within the first and second bores.

4. The showerhead assembly of claim 1, wherein the front faceplate, the rear housing and the plurality of scanner nozzles define at least one of a fixed showerhead and a handshower.

5. The showerhead assembly of claim 1, wherein the front faceplate, the rear housing and the plurality of scanner nozzles define a handshower, and the handshower is removably coupled to a fixed showerhead.

6. A showerhead assembly comprising:

a first fluid dispensing unit including a first plurality of stepped bores, and a first plurality of scanner nozzles received within the first plurality of stepped bores;

a second fluid dispensing unit removably coupled to the first fluid dispensing unit, the second fluid dispensing unit including a second plurality of stepped bores, and a second plurality of scanner nozzles received within the second plurality of stepped bores;

wherein the first plurality of scanner nozzles are angled at a different angular orientation relative to a longitudinal axis of the showerhead assembly than the second plurality of scanner nozzles; and wherein each scanner nozzle includes an upstream end member and a downstream end member defining an oscillation chamber; and wherein each of the stepped bores includes an engagement portion angled relative to the longitudinal axis, each engagement portion contacting a respective one of the upstream end members.

7. The showerhead assembly of claim 6, wherein the first fluid dispensing unit is a fixed showerhead, and the second fluid dispensing unit is a handshower removably coupled to the fixed showerhead.

8. The showerhead assembly of claim 7, wherein:

the fixed showerhead includes a front faceplate and a rear housing supporting the front faceplate, the front faceplate including the first plurality of stepped bores and the rear housing including a rear wall; and the handshower includes a front faceplate and a rear housing supporting the front faceplate, the front faceplate including a front wall and the second plurality of stepped bores and the rear housing including a rear wall.

9. The showerhead assembly of claim 8, wherein the front faceplate of the handshower defines the longitudinal axis, and the first plurality of stepped bores include a longitudinal axis angled from the longitudinal axis of the front faceplate of the handshower.

10. The showerhead assembly of claim 9, wherein the first plurality of stepped bores define an outer ring of stepped bores and an inner ring of stepped bores, and wherein a longitudinal axis of the outer ring of stepped bores is angled from the longitudinal axis of the front faceplate at an angle greater than a longitudinal axis of the inner ring of stepped bores is angled from the longitudinal axis of the front faceplate.

11. The showerhead assembly of claim 8, further comprising an o-ring compressed between each of the scanner nozzles and the front faceplate to secure the scanner nozzles within the fixed showerhead and the handshower.

* * * * *